US006679811B2

(12) United States Patent
Chen

(10) Patent No.: US 6,679,811 B2
(45) **Date of Patent: *Jan. 20, 2004**

(54) AIR ENCLOSURE TRAMPOLINE SAFETY SYSTEM

(76) Inventor: Sam Sheng Chen, Wendy Apartment Flat l/c No. 19 Upper Green Lane, Hong Kong (CN)

( * ) Notice: Subject to any disclaimer, the term of this patent is extended or adjusted under 35 U.S.C. 154(b) by 165 days.

This patent is subject to a terminal disclaimer.

(21) Appl. No.: 09/867,343

(22) Filed: May 29, 2001

(65) Prior Publication Data

US 2002/0183166 A1 Dec. 5, 2002

(51) Int. Cl.[7] ..... A63B 5/11
(52) U.S. Cl. ..... 482/29; 482/27
(58) Field of Search ..... 482/27–29; 446/220–222

(56) References Cited

U.S. PATENT DOCUMENTS

| | | | | |
|---|---|---|---|---|
| 3,994,102 A | * | 11/1976 | Johnson et al. | 52/2 |
| 5,575,738 A | * | 11/1996 | Millington et al. | 482/35 |
| 5,669,858 A | * | 9/1997 | Blair et al. | 482/78 |
| 6,336,893 B1 | * | 1/2002 | Chen | 482/29 |

* cited by examiner

*Primary Examiner*—Nicholas D. Lucchesi
*Assistant Examiner*—Lori Baker Amerson

(57) ABSTRACT

The present invention relates to a protection device for a trampoline, wherein the protection device comprises a plurality of support parts, the two ends of each support part being separately installed with an upper half part and a lower half part; and a protection film being installed between two support parts. Finally, the protection device is combined with a trampoline in order to ensure the safety of a person exercising on the trampoline.

16 Claims, 3 Drawing Sheets

12
2
2
14
11
11
3
3
13
40

AIR ENCLOSURE TRAMPOLINE SAFETY SYSTEM

BACKGROUND OF THE INVENTION

1. Field of the Invention

The present invention relates to a safety system for a trampoline.

2. Description of Related Art

The current trend of physical health and fitness has popularized a wide variety of exercise such as the trampoline. More specifically, trampoline has gained great popularity, and is now featured as an Olympic sport. Trampolines are often found in gymnasiums or stadiums. Unfortunately trampoline use risks injury because trampolines traditionally lack safety devices.

Users can suffer injuries when falling off a trampoline or falling on the frame of a trampoline. Traditionally a spongy pad is placed around the trampoline periphery to prevent injury if a user lands outside the trampoline. The spongy pad material absorbs shock and softens a hard landing.

Trampolines can be built to have enclosures as seen in assignee Jumpsport 6,053,845, having an octagonal enclosure. Trampolines currently on the market are not easily upgradeable to have enclosures. Often times, complicated connection hardware is required. Coan 5,941,798 showing an inverted frustro conical configuration bounces a user towards the middle of the trampoline. Unfortunately, a user can still land outside of the trampoline or on the frame of the trampoline.

SUMMARY OF THE INVENTION

The invention is an inflatable trampoline enclosure. The inflated trampoline enclosure fits over a trampoline to cover the trampoline frame. Inflated walls prevent the user from landing outside of the trampoline area. Hardware secures the inflatable trampoline enclosure to the trampoline frame.

DESCRIPTION OF THE PREFERRED EMBODIMENT

The invention is an inflatable trampoline enclosure. The enclosure fits over a trampoline to cover the trampoline frame. Inflated walls prevent the user from landing outside of the trampoline area. Hardware secures the inflatable trampoline enclosure to the trampoline frame.

Figure 1:
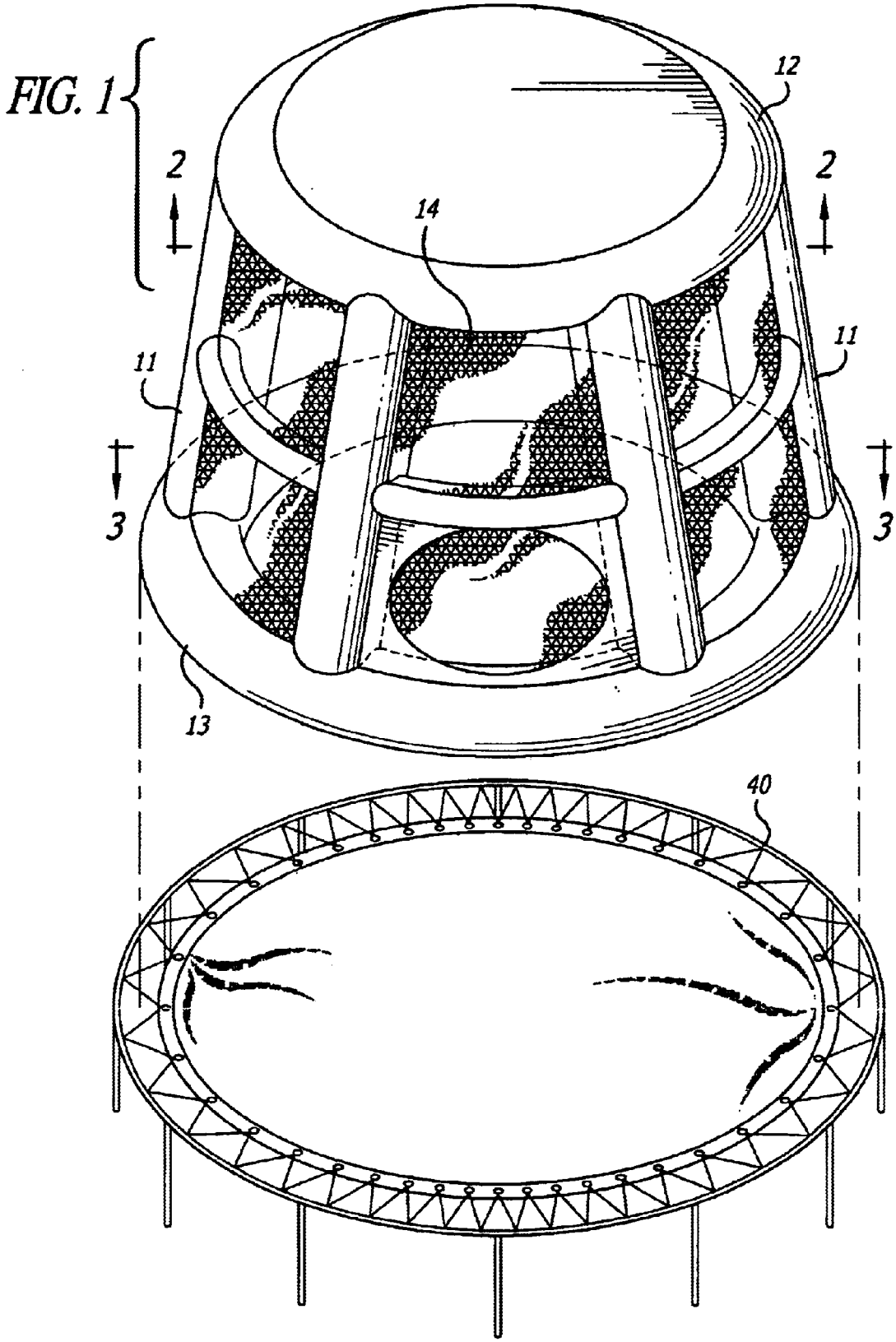
FIG. 1: A 3-D schematic diagram of the present invention.
Figure 2:
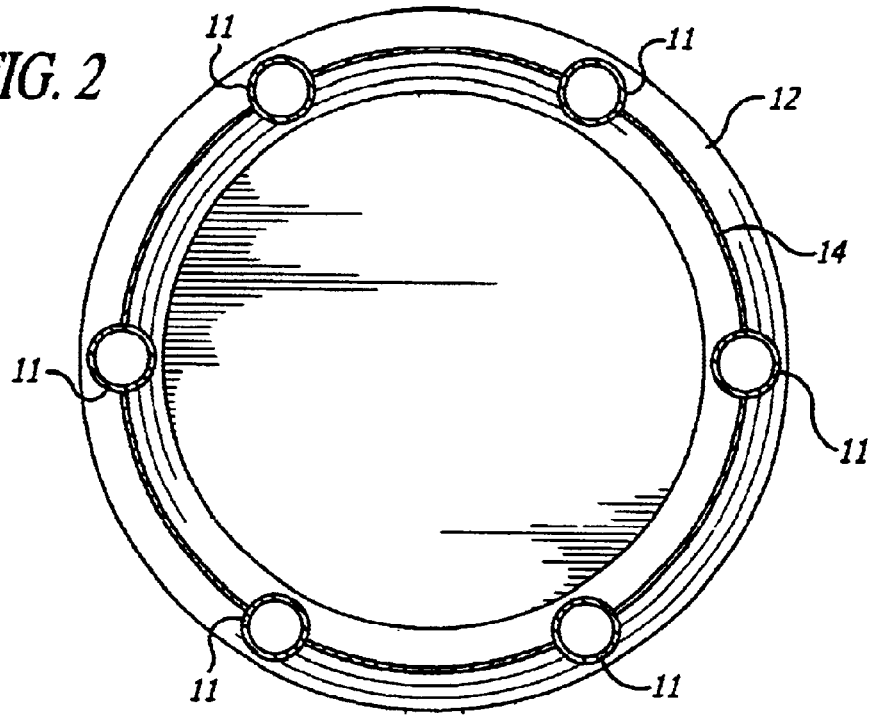
FIG. 2: A schematic diagram for the present invention under use.
Figure 3:
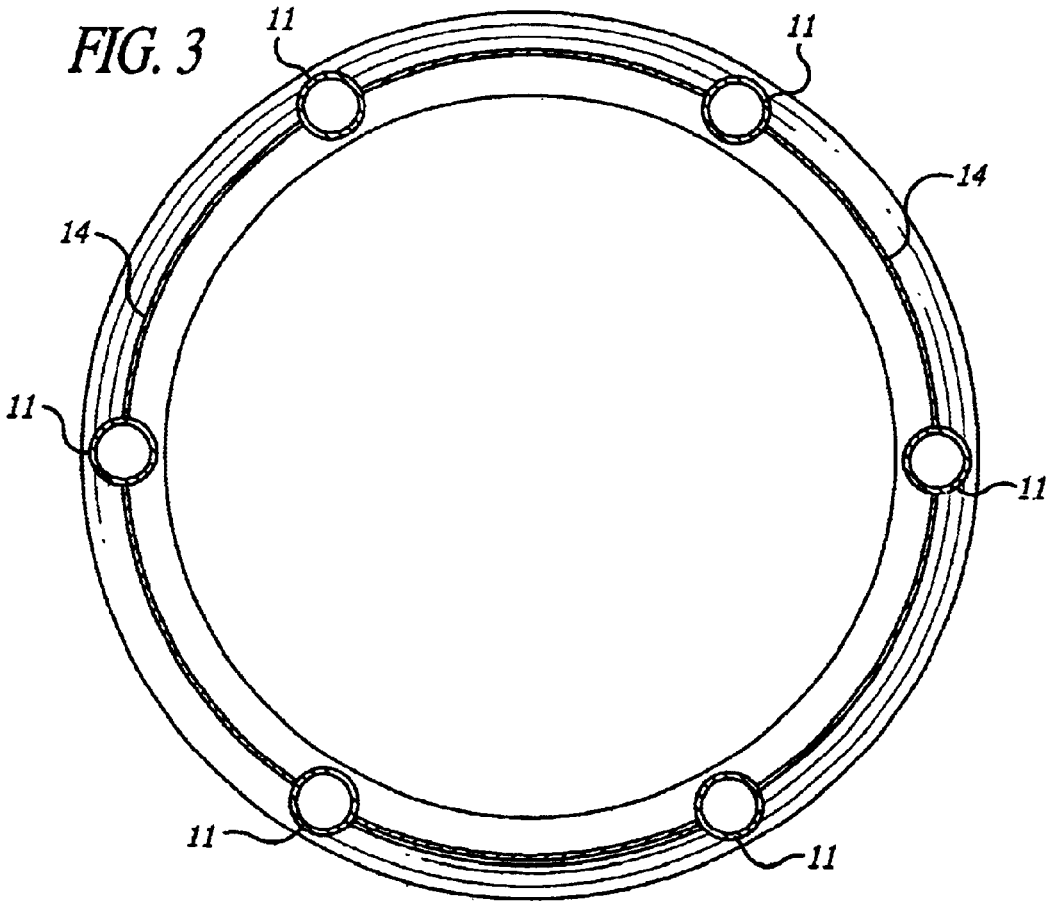
FIG. 3: A schematic diagram for an assembly of the present invention and a trampoline.

FIG. 1 shows the present invention. The inflatable trampoline enclosure has an upper ring, a lower ring and supporting columns (also called support parts). The upper ring (annular upper half part), lower ring (annular lower half part) and supporting columns are interconnected to form a trampoline enclosure frame. The enclosure frame is inflatable and can be made from materials commonly used for other inflatable devices. When deflated, the enclosure frame can be stored in a small container such as a bag or a box. The enclosure frame can be stored in a very small space because it needs no rigid structural parts except for the hardware necessary to attach the frame to the trampoline. This allows ease in shipping as well.

Columns extend from the lower ring to support the upper ring. Space between the columns form windows that are closed with netting (protection film). Netting allows users inside the trampoline enclosure to see outside and maintain visual orientation. FIG. 1 shows a 3-D schematic diagram of the present invention. As shown in FIG. 1, the protection device 1 comprises a plurality quantity of support parts 11. The two ends of each support part 11 being separately installed with an annular upper half part 12 and an annular lower half part 13, and a protection film 14 being installed between two support parts 11. Each of the support part 11, the upper half part 12 and the lower half part 13 are gas-filled bodies, wherein the upper half part 12 and the lower half part 13 are multilateral bodies. The support part 11, the upper half part 12 and the lower half part 13 are installed with gas-filling openings 111, wherein the protection film 14 between two supports parts 11 is installed with a plurality of air permeable openings; furthermore, at least one face of the protection film 14 is openable so that a user can enter the enclosure without removing the enclosure from the frame.

The periphery of the openable protection film 14 is installed with an opening and closing element, wherein the opening and closing element is a slide fastener assembly or a button assembly. The opening entrance can also be opened and closed by means of a zipper. The protection film 14 can be made of transparent or non-transparent material in a variety of colors. Each of the support part 11, the upper half part 12 and the lower half part 13 can form an interconnected state and be inflated through a gas-filling opening. On the other hand, it would also be easy to allow separate cells and require them to be separately inflated. Each configuration has its advantages and disadvantages.

The enclosure can have loops, cords or other attachment means secured to the lower ring to allow a user to connect the enclosure to the frame of a trampoline FIG. 1, 40. The trampoline frame is usually made of a steel truss structure to which hook and loop tape straps, cords or other means can be used to attach to the structure.

Figure 4:
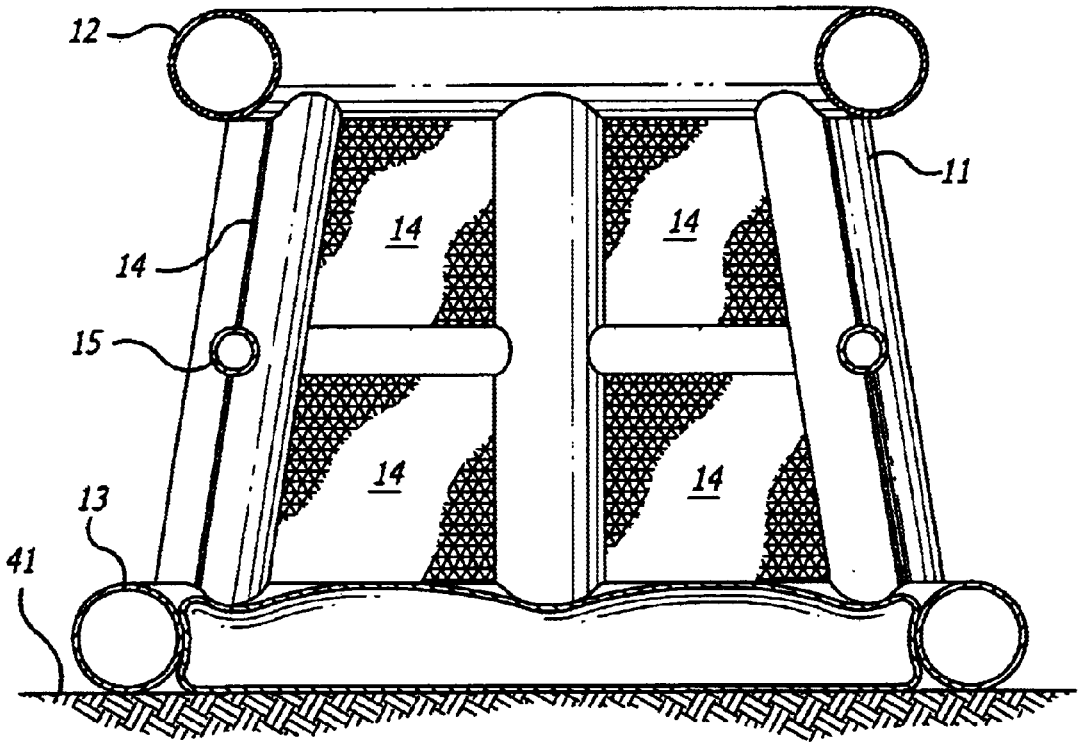
FIG. 4 shows the trampoline enclosure on the ground used as a playpen.

The bottom of the structure can be open, covered with protection film or covered with a inflatable bouncing cell that allows a user to jump on the bouncing cell. These various versions have their own advantages. The circular bouncing cell enclosed in the lower ring can allow the enclosure to double as a standalone trampoline for children and those of lesser weight. The bouncing cell can protect a user by preventing a user from landing directly on the interface between the enclosure and a trampoline frame or spring. The enclosure is also suitable as a playpen. FIG. 4 shows the trampoline enclosure on the ground used as a playpen.

Therefore, the present invention combines a protection device with a trampoline to provide safety to a user exercising on the trampoline such that the user can exercise on the trampoline in a safe environment and prevent himself/herself from being injured by falling off the trampoline.

The present invention completely eliminates the conventional drawbacks and endows a trampoline, in addition to exercise functions, with safety features. However, the above-mentioned disclosure is only a preferred embodiment of the present invention, and is not used to limit the scope of the present invention. Any equivalent modification or alteration of the claims of the present invention is within the scope of the present invention.

What is claimed is:

1. A trampoline safety device comprising: a plurality of support parts, the two ends of each support part being separately installed with an upper half part and a lower half part, and a protection film being installed between two support parts, wherein one face of the protection film is openable, and the periphery of the openable protection film is installed with an opening and closing element, thereby forming the protection device.

2. The trampoline safety device of claim 1, wherein each of the support part, the upper half part and the lower half part are gas-filled bodies.

3. The trampoline safety device of claim 1, wherein each of the support part, the upper half part and the lower half part are installed with gas-filling openings at appropriate positions, or each of the support part, the upper half part and the lower half part form an interconnected state and are inflated through a gas-filling opening.

4. The trampoline safety device of claim 1, wherein the protection film between the support parts is installed with a plurality of air permeable openings.

5. The trampoline safety device of claim 1, wherein the upper half part and the lower half part are annular bodies.

6. The trampoline safety device of claim 1, wherein the upper half part and the lower half part are multilateral bodies.

7. The trampoline safety device of claim 1, wherein the lower half part is open to the surface of the trampoline.

8. The trampoline safety device of claim 1, wherein the opening and closing element is a slide fastener assembly.

9. The trampoline safety device of claim 1, wherein the opening and closing element is a button assembly.

10. A trampoline safety device of claim 1, wherein a lower part of the protection is combined with a frame mounted with the trampoline through a plurality of fastening elements.

11. The trampoline safety device of claim 10, wherein the fastening element is a hook and loop tape strap.

12. The trampoline safety device of claim 10, wherein the fastening element is a male-female buckling element.

13. A trampoline safety device comprising: a plurality of support parts, the two ends of each support part being separately installed with an upper half part and a lower half part, and a protection film being installed between two support parts, wherein one face of the protection film is openable.

14. The trampoline safety device of claim 13, wherein each of the support parts defines a cell, wherein the upper half defines a cell, wherein the lower half defines a cell, wherein separate cells are separately inflated having no air flowing between the cells.

15. The trampoline safety device of claim 13, wherein a bouncing cell conforming to the shape of the inside of the lower ring can be attached to the inside of the lower ring, wherein separate cells are separately inflated having no air flowing between the cells.

16. The trampoline safety device of claim 15, wherein the bouncing cell connects to and allows sharing of air with the trampoline safety device.

* * * * *